US005971167A

United States Patent [19]

Finbow

[11] Patent Number: 5,971,167

[45] Date of Patent: Oct. 26, 1999

[54] HOLDER FOR STEMMED DRINKING VESSELS

[76] Inventor: David Finbow, 29 Munro Park, Toronto Ontario, Canada, M4E 3M2

[21] Appl. No.: 09/205,724

[22] Filed: Dec. 4, 1998

[51] Int. Cl.[6] ..... A47F 7/00

[52] U.S. Cl. ..... 211/71.01; 211/85.29; D7/701; 206/426; 248/310

[58] Field of Search ..... 211/71.01, 85.29; D7/701, 703, 705; 206/426; 248/310, 311.3

[56] References Cited

U.S. PATENT DOCUMENTS

| | | | |
|---|---|---|---|
| 1,925,540 | 9/1933 | Neuschotz | 248/23 |
| 2,816,667 | 12/1957 | Tanay | 211/76 |
| 3,171,544 | 3/1965 | Unsworth | 211/71 |
| 3,214,031 | 10/1965 | McCauley | 211/71 |
| 3,746,178 | 7/1973 | Wagschal | 211/74 |
| 4,304,328 | 12/1981 | Pilat | 206/426 X |
| 4,318,485 | 3/1982 | Clement | 211/49 |
| 4,334,623 | 6/1982 | Geary | 211/85.29 |
| 4,589,556 | 5/1986 | Peretz | 211/41 |
| 4,700,849 | 10/1987 | Wagner | 211/71 |
| 4,860,895 | 8/1989 | Iaslovits | 206/426 |

*Primary Examiner*—Robert W. Gibson, Jr.
*Attorney, Agent, or Firm*—Bereskin & Parr

[57] ABSTRACT

A holder for stemmed drinking vessels having a base and a bowl connected by a stem. The holder has a support structure and vessel supports are disposed on the support member to support a plurality of vessels with their stems crossed. In preferred embodiments the support structure is formed symetrically about an axis to define an interior space for receiving the vessels.

24 Claims, 4 Drawing Sheets

HOLDER FOR STEMMED DRINKING VESSELS

FIELD OF THE INVENTION

This invention relates to devices for holding stemmed drinking vessels such as wine glasses, champagne flutes and the like for the purposes of transport, storage, washing or display.

BACKGROUND OF THE INVENTION

Stemmed drinking vessels have awkward shapes that make it difficult to transport, store, wash or display the vessels in a space optimizing manner. Holders have been developed that suspend vessels upside down in a side by side relationship by engaging the base or bowl of the vessels on either side of the stem. Examples of such devices are disclosed in U.S. Pat. Nos. 1,925,540; 3,171,544; 3,214,030; 4,589,556; and 4,700,849. None of these prior holders optimize the number of vessels occupying a volume of space.

SUMMARY OF THE INVENTION

In one aspect of the present invention there is provided a holder for stemmed drinking vessels comprising:

a support structure; and vessal support means disposed on said support structure for supporting a plurality of said vessels with their stems crossed.

In another aspect of the present invention there is provided a holder for stemmed drinking vessels comprising:

a support structure formed symetrically about an axis to define an interior space for receiving said vessals; and vessal support means disposed on said support structure for supporting in said interior space a plurality of said vessels with their stems crossed.

BRIEF DESCRIPTION OF THE FIGURES

For a better understanding of the present invention, and to show more clearly how it may be carried into effect, reference will now be made, by way of example, to the accompanying drawings. The drawings show preferred embodiments of the present invention, in which.

DETAILED DESCRIPTION OF THE PREFERRED EMBODIMENT

Figure 1:
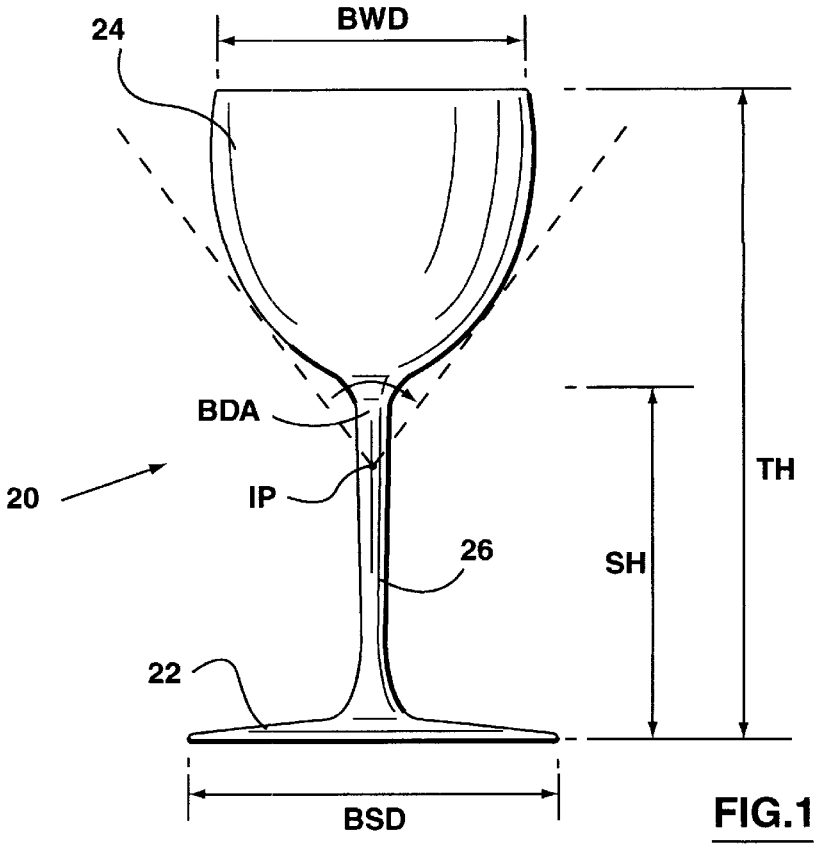
FIG. 1 is a side view of a stemmed drinking vessel as defined herein.

A "stemmed drinking vessel" is shown generally at 20 in FIG. 1 and is defined herein as an article having a base 22 and a bowl 24 connected by a stem 26. The stem 26 may be either hollow or solid. As shown in FIG. 1, the stemmed drinking vessel 20 (used interchangeably with "vessel" herein) has dimensions including the top edge bowl diameter BWD, the bowl diameter angle BDA (measured from the vessel intersection point IP as described further below), the base diameter BSD, the stem height SH and the total vessel height TH.

A holder for supporting stemmed drinking vessels 20 in accordance with the present invention is shown generally at 30 in FIGS. 2–10. Different embodiments of the holder are described below with corresponding reference numerals being assigned to corresponding elements.

Figure 2:
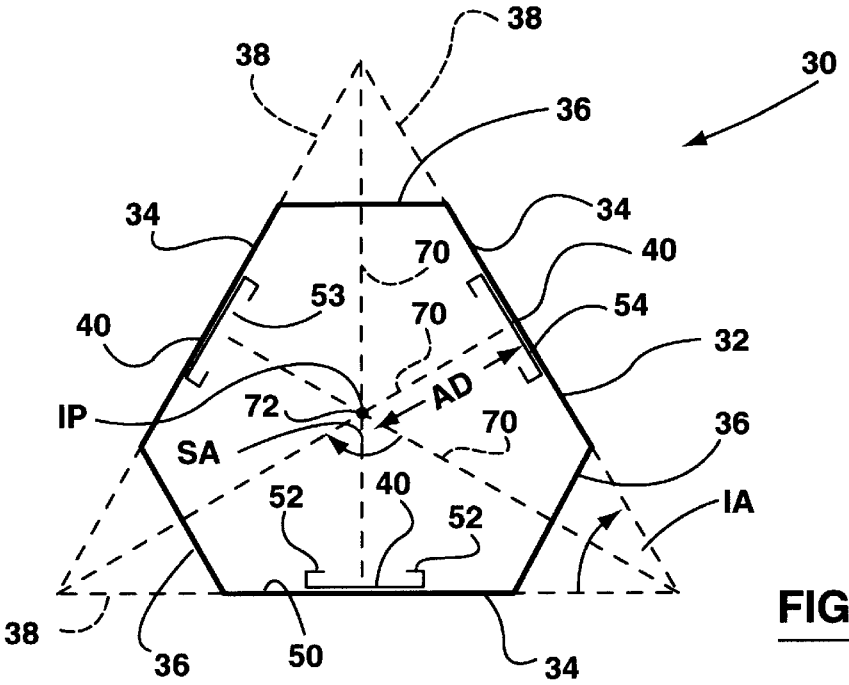
FIG. 2 is a top view of a holder in accordance with the present invention.
Figure 3:
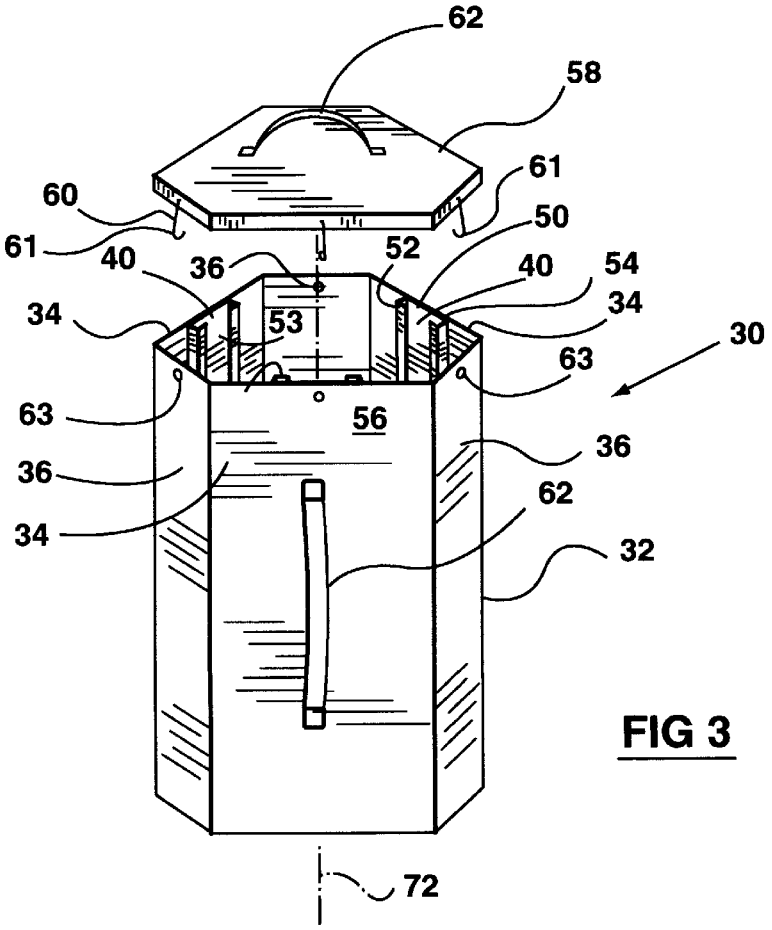
FIG. 3 is an exploded side view of the holder of FIG. 2 in combination with a lid.

Referring to FIGS. 2 and 3, a first embodiment of the holder is shown. The holder comprises a rigid support structure 32 that defines an interior space for receiving the vessals 20. The support structure 32 has three support members 34 and three spanning members 36. The support members 34 are arranged in planes 38 that intersect each other at an intersection angle IA. In the preferred embodiment the support members 34 are arranged in planes 38 intersecting at an angle IA of approximately 60°.

The spanning members 36 are positioned to extend between adjacent support members 34. It will be appreciated that all or some of the spanning members 36 may be shortened or completely eliminated such that the support structure 32 is formed substantially or fully by the support members 34 (i.e., as an equilateral triangle).

Vessel supports 40 are disposed on the support members 34 to support the vessels 20 in a position where the stems 26 of the vessels 20 are crossed. The vessel supports 40 comprise tracks 50 having opposing flanges 52 that are sized and spaced to slideably receive and support the edges of the base 22 of a vessel 20. A gap 53 is defined between the opposing flanges 52 to accommodate the stem 26 of a vessel 20. The tracks 50 may be elongate as shown in FIG. 2 for receiving a plurality of vessels 20. Alternatively, the vessel supports 40 may be distinct units for receiving the base 22 of a single vessel 20 only. The vessel supports 40 are either integrally formed with the support members 34 or mounted to the support members 34 with fasteners 54 such as glue, double-sided tape, welds, rivets, screws or bolts.

It will be understood that other forms of vessel supports 40 may be utilized for supporting the vessels 20. Examples of other forms of vessel supports 40 are disclosed in U.S. Pat. Nos. 1,925,540, 3,171,544, 3,214,031, 4,589,556 and 4,700,849, all of which are incorporated herein by reference.

The support members 34 and spanning members 36 of the support structure 32 are formed with continuous walls 56 that shelter the vessels 20 contained within the support structure. The support structure 32 may be formed out of plastic as a one piece unit by an extrusion or blow molding process. Alternatively, the hollow support structure 32 may be formed from cardboard, metal, wood, styrofoam or other suitable materials. A lid 58 is fitted to an open end of the support structure 32 so as to snugly engage the outer surface of the walls of the support structure. The lid 58 may be fully removable as shown or connected by a hinge (not shown) to the hollow support structure. Connectors 60 such as hooks 61 and eyes 63, latches, string connectors or the like may be provided to releasably connect the lid 58 and support structure 32 together. Handles 62 are provided on the lid 58 and support structure 32 to facilitate transport of the holder or easy removal of the lid 58.

The holder depicted in FIGS. 2 and 3 provides a space optimizing arrangement of vessels 20. The vessel supports 40 are located on each support member 34 at a position that places the stem 26 of a vessel 20 supported by the vessel support 40 in a stem plane 70 that crosses at an intersection point IP with a central axis 72 of the support structure. The distance AD between the support member 34 and the central axis 72 is less than the stem height SH for the intended vessels 20. The vessels 20 are arranged on the holder in a stack with a single vessel 20 mounted on successive adjacent support members 34. The stems 26 of the vessels 20 preferably abut one another when they cross at the intersection point IP. The stem planes 70 of adjacent vessels 20 intersect at a stem plane angle SA. The stem plane angle SA is greater than the bowl diameter angle BDA in order for the intended vessels 20 to fit within the support structure. The bowl diameter angle BDA is measured from the intended intersection point IP for the vessels 20.

A three sided holder as depicted in FIGS. 2 and 3 will support vessels 20 most efficiently in multiples of three. In this preferred embodiment, the stems 26 are arranged equilangularly in stem planes 70 that intersect the central axis 72 at a stem angle SA of approximately 120°.

Figure 4:
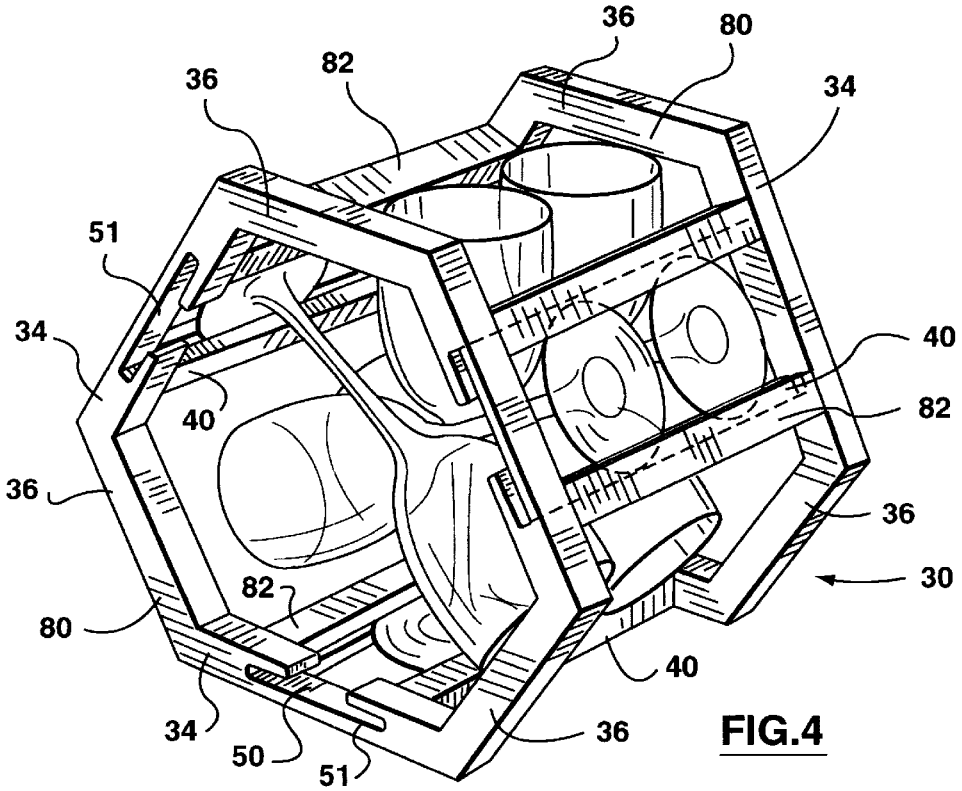
FIG. 4 is a perspective view of a second embodiment of a holder in accordance with the present invention.

Instead of forming the support structure 32 with continuous walls 56, the support structure 32 may be formed with an open frame as shown in FIG. 4. The frame would be sufficiently rigid to maintain the integrity of the support structure 32 and would include opposing ends 80 and connectors 82. The ends 80 each define the support members 34 and spanning members 36. Openings 51 to tracks 50 of vessel supports 40 are defined in the support members 34 for each end 80. The connectors 82 extend between the ends 80 and define the remaining portion of tracks 50. The connectors 82 may be integrally formed with the ends 80 or they may be fastened to ends 80 with fasteners 54 (not shown).

Figure 5:
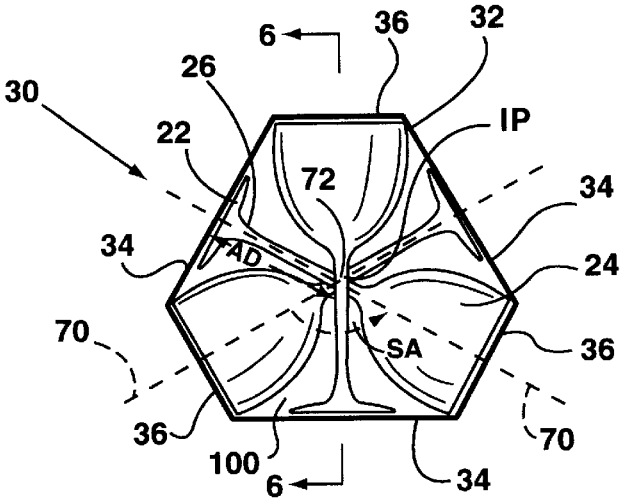
FIG. 5 is a top view of a third embodiment of a holder in accordance with the present invention.
Figure 6:
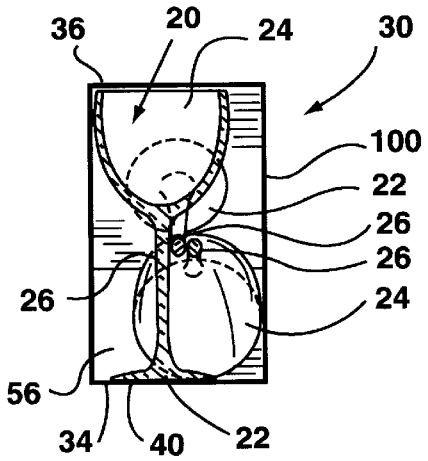
FIG. 6 is a sectional view of the holder of FIG. 5 taken along lines 6—6.

Referring to FIGS. 5 and 6, a third embodiment of the holder is depicted. The holder is sized for carrying three intersecting vessels 20 and is preferred for use as a cost effective and attractive means for packaging and displaying vessels 20. The support structure 32 includes support members 34 and spanning members 36 formed with continuous walls 56, including a back wall 100. The support structure 32 may be formed from a variety of materials as noted above but cardboard is preferred because of its low cost. A multiply cardboard support structure 32 will generally provide satisfactory protection for the vessels 20 contained in the holder. Foam padding (not shown) may be included in the support structure 32 for added protection.

The support members 34 abuttably receive the bottom surface of the vessel bases 22. The support members 34 and spanning members 36 together function as vessel supports 40 by positioning the vessel 20 with the stem 26 along the desired stem plane 70. The spanning members 36 are positioned at a distance relative to the opposing support members 34 that closely approximates the total height TH of the vessel 20 intended to be carried in the holder. The length of the spanning members 36 is chosen to closely approximate the outside diameter of the bowl 24 of the drinking vessel 20 at its top edge. As may be seen in FIG. 6, this combination of dimensions optimizes the space within the hollow support structure 32 and allows the vessels 20 to be snugly supported between the support members 34 and spanning members 36. The stem plane angle SA for the vessels 20 as arranged in the holder is greater than the bowl diameter angle BDA of the vessel 20 and the central axis distance AD is less than the stem height SH for the vessel 20.

Figure 7:
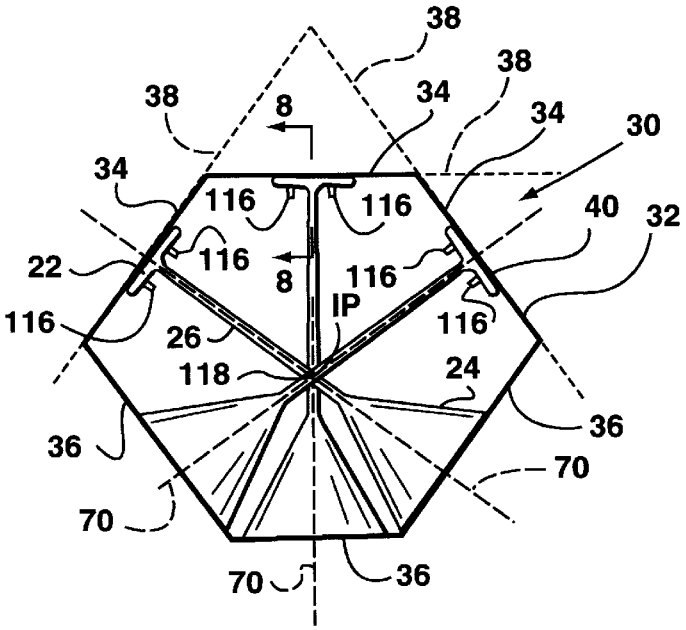
FIG. 7 is a top view of a fourth embodiment of a holder in accordance with the present invention.
Figure 8:
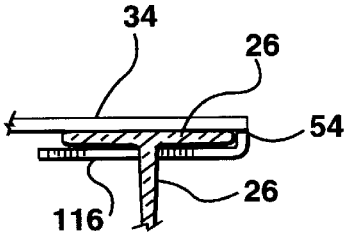
FIG. 8 is a sectional view of the holder of FIG. 7 taken along lines 8—8.

Referring to FIGS. 7 and 8, a fourth embodiment of the holder is depicted. The holder comprises a support structure 32 having support members 34 arranged in intersecting planes 38. Each support member 34 includes a vessel support 40. As shown in FIG. 7, the vessel support 40 includes a pair of arms 116 that are mounted to the support member 34 with fasteners 54 and are spaced with a gap 53 to extend on either side of a vessel stem 26 adjacent to the top surface of the base 22. The arms 116 are be spring biased to resiliently grip the base 22 on opposing sides of the stem 26.

The arrangement of the support members 34 and vessel supports 40 for the fourth embodiment of holder is selected such that the stems 26 of the vessels 20 extend along stem planes 70 that intersect at intersection points IP along a common intersection axis 118. As before, the stem plane angle SA for the vessels 20 as arranged in the holder is greater than the bowl diameter angle BDA of the vessel 20 as measured from the intersection point IP. Also, the axis distance AD from the intersection axis 118 to the respective support members 34 is less than the stem height SH for the vessel 20.

The support structure 32 includes spanning members 36 for defining an interior space for the support structure. Alternatively, the support structure 32 may simply comprise the support members 34 with the bowls of the vessels 20 remaining exposed.

The support structure 32 may be mounted to a surface (not shown) with the intersection axis 118 extending in a vertical or horizontal plane 38. Alternatively, such a holder may be incorporated into a dishwasher rack for supporting vessels in a space-efficient and protective manner for washing.

Figure 9:
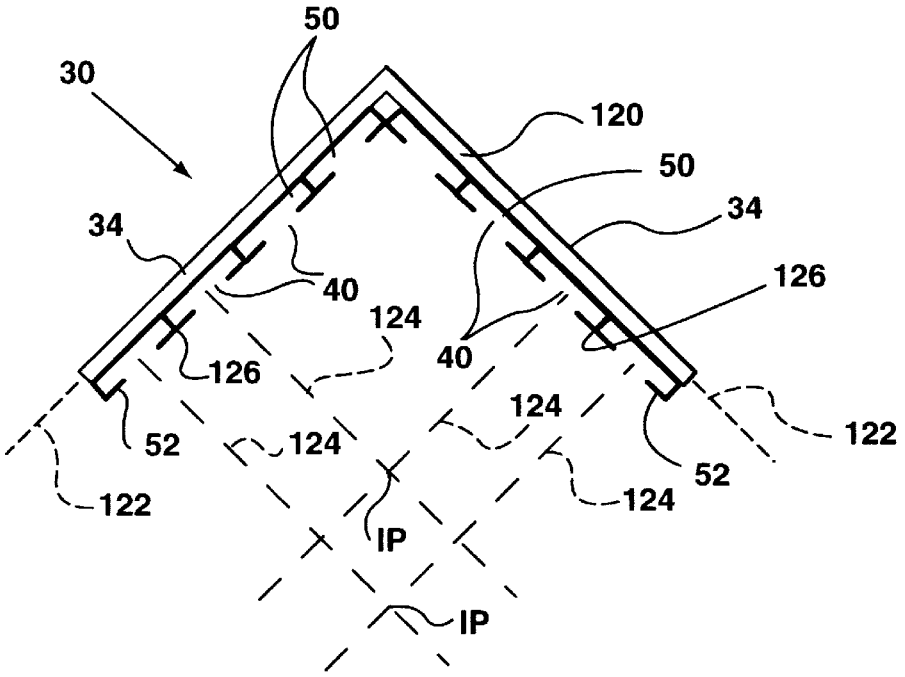
FIG. 9 is a top view of a fifth embodiment of a holder in accordance with the present invention.

Referring to FIG. 9, a fifth embodiment of the holder is depicted. The holder includes an elongate support structure 120 (shown in top view only) having two support members 34 arranged in intersecting planes 122. A series of vessel supports 40 are disposed on each of the support members 34 for permitting vessels 20 to be arranged with their stems 26 along various parallel stem planes 124 that intersect at intersection points IP with the stem planes 70 of vessels 20 correspondingly mounted in the opposing support member 34. The vessel supports 40 may include arms 116 as described above for engaging the vessel bases 22 on opposing sides of the stem 26 or preferably tracks 50 with flanges 52 for slideably receiving the vessel bases 22. The flanges 52 may include T-flanges 126 in cases where flanges 52 are arranged side by side. This embodiment of holder may also be incorporated into a dishwasher rack as a means to hold different shapes and sizes of vessels 20 in a space-efficient and protective manner for washing.

Figure 10:
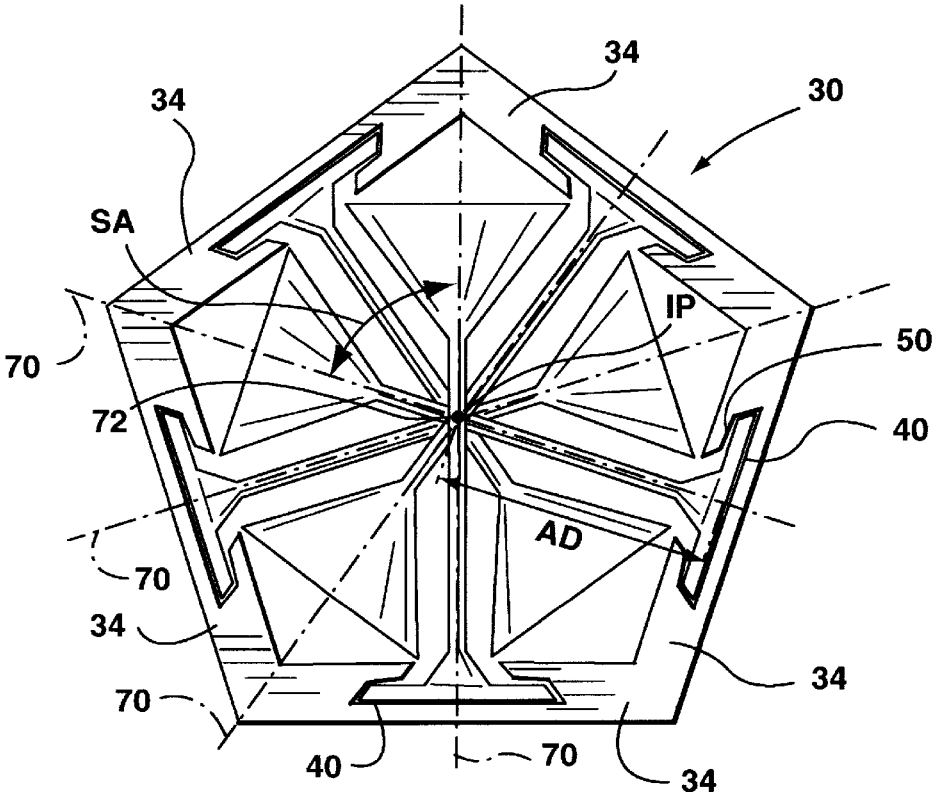
FIG. 10 is a top view of a sixth embodiment of a holder in accordance with the present invention.

Referring to FIG. 10, a sixth embodiment of the holder is depicted. The holder includes a rigid elongate support structure 32 (shown in top view only) that defines an interior space for receiving vessals 20. The holder has five support members 34. Spanning members 36 are not provided with this embodiment but may be included if desired for space or aesthetic considerations. Vessel supports 40 are disposed on each support vessel 34 similar to the embodiments depicted and described above.

In order to optimize the space-efficient arrangement of vessels 20 within the hollow support structure, the vessel supports 40 are located on each support member 34 at a position that places the stem 26 of a vessel 20 supported by the vessel support 40 in a stem plane 70 that intersects at an intersection point IP with a central axis 72 of the support structure. The distance AD between the support member 34 and the central axis 72 is less than the stem height SH for the vessel 20. The vessels 20 are arranged on the holder in a stack with a single vessel 20 mounted on successive adjacent support members 34. The stems 26 of the vessels 20 preferably abut one another at the intersection point IP. The stem planes 70 of adjacent vessels 20 intersect at a stem plane angle SA. The stem plane angle SA is greater than the bowl diameter angle BDA in order for the vessels 20 to fit. The bowl diameter angle BDA is measured from the intended intersection point IP for the vessels 20.

In this manner, the vessals 20 may be arranged in multiples of five about the axis 72. It will be appreciated that other numbers of vessals 20 may be arranged about the axis 72 with the stem plane angle SA between adjacent vessals 20 being determined by dividing 360 degrees by the number of vessals 20 that are desired to be arranged about the axis 72.

It is to be understood that what has been described is a preferred embodiment to the invention. The invention nonetheless is susceptible to certain changes and alternative embodiments fully comprehended by the spirit of the invention as described above, and the scope of the claims set out below.

I claim:

1. A holder for stemmed drinking vessels comprising:

a support structure; and vessel support means disposed on said support structure for supporting a plurality of said vessels with their stems crossed.

2. A holder as claimed in claim 1 wherein said stems cross along a common intersection axis.

3. A holder as claimed in claim 1 wherein the stems of adjacent vessels abut one another.

4. A holder as claimed in claim 1 wherein said vessel support means comprises means for engaging the base of each of said vessel to support said vessel in a desired position.

5. A holder as claimed in claim 4 wherein said engaging means comprises a track for slidably receiving and supporting the base.

6. A holder as claimed in claim 5 wherein said track has flanges that extend over the edge of the base on opposing sides of the stem.

7. A holder as claimed in claim 5 wherein said track has stringers extending across the top surface of the base on opposing sides of the stem.

8. A holder as claimed in claim 4 wherein said engaging means comprises resiliently biased arms for resiliently gripping the base on opposing sides of the stem.

9. A holder as claimed in claim 1 wherein said support structure defines an interior space for receiving said vessels.

10. A holder as claimed in claim 1 wherein said support structure includes a plurality of rigid support members arranged in intersecting planes relative to each other, said vessel support means being disposed on said support members.

11. A holder as claimed in claim 10 wherein said support structure includes spanning members for spanning between said support members.

12. A holder as claimed in claim 10 wherein said support members are arranged relative to each other to define an interior space within said support structure for receiving said vessels.

13. A holder as claimed in claim 12 wherein said support members are arranged equilangularly relative to each other.

14. A holder as claimed in claim 13 wherein said support structure includes three support members with each said support member extending at an intersection angle of approximately 60° relative to an adjacent support member.

15. A holder for stemmed drinking vessels comprising:

a support structure formed symetrically about an axis to define an interior space for receiving said vessels; and vessel support means disposed on said support structure for supporting in said interior space a plurality of said vessels with their stems crossed.

16. A holder as claimed in claim 15 wherein a plurality of vessel support means is provided, said vessal support means being arranged equidistantly to each other about said axis.

17. A holder as claimed in claim 15 wherein said vessels are supported with their stems extending in planes arranged equiangularly to each other.

18. A holder as claimed in claim 16 wherein the stems of adjacent vessels are support by said vessel support means to extend along planes that intersect at a stem plane angle of 360 degrees divided by the number of vessels arranged about the axis.

19. A holder as claimed in claim 15 wherein said stems cross along a common intersection axis.

20. A holder as claimed in claim 15 wherein the stems of adjacent vessels abut one another.

21. A holder as claimed in claim 15 wherein said vessel support means comprises means for engaging the base of each of said vessels to support said vessel in a desired position.

22. A holder as claimed in claim 21 wherein said engaging means comprises a track for slidably receiving and supporting the base.

23. A holder as claimed in claim 22 wherein said track has flanges that extend over the edge of the base on opposing sides of the stem.

24. A holder as claimed in claim 22 wherein said track has stringers extending across the top surface of the base on opposing sides of the stem.

* * * * *